United States Patent [19]

Henderson

[11] 4,086,922

[45] May 2, 1978

[54] METHOD AND APPARATUS FOR TREATING CELLULITE CONTAINING AREAS OF THE HUMAN BODY

[76] Inventor: Burnis Henderson, 5214 17th St., Lubbock, Tex. 79416

[21] Appl. No.: 721,452

[22] Filed: Sep. 8, 1976

[51] Int. Cl.[2] ..... A61H 29/00

[52] U.S. Cl. ..... 128/24.3

[58] Field of Search ..... 128/57, 24.3, 67, 25 B

[56] References Cited

U.S. PATENT DOCUMENTS

| | | | |
|---|---|---|---|
| 2,285,105 | 6/1942 | Bacher | 128/24.3 |
| 2,748,763 | 6/1956 | Kosloff | 128/57 |

FOREIGN PATENT DOCUMENTS

| | | | |
|---|---|---|---|
| 36,174 | 7/1930 | Germany | 128/57 |
| 314,282 | 6/1929 | United Kingdom | 128/57 |

*Primary Examiner*—Lawrence W. Trapp

*Attorney, Agent, or Firm*—Fishburn, Gold & Litman

[57] ABSTRACT

An instrument for massaging and kneading areas of the human body having cellulite therein and having a base member larger than a hand of a user with a flexible member extending thereover and having an opening for the user's hand to be positioned on the base member. A plurality of closely spaced balls are supported under the base plate for rotation with the axes of rotation substantially parallel and generally in a plane spaced below the base member. The balls are resiliently mounted to permit movement of the balls in a direction normal to the axial plane thereof to tend to equalize the pressure of the balls on an uneven surface engaged thereby. Heating means is supported by the base plate and positioned to apply heat to the balls and the body area thereunder.

7 Claims, 5 Drawing Figures

METHOD AND APPARATUS FOR TREATING CELLULITE CONTAINING AREAS OF THE HUMAN BODY

This invention relates to the method and apparatus for treating cellulite containing areas of the human body and more particularly to a method and apparatus for applying heat and a rolling massage pressure on the areas of the body having cellulite therein.

Cellulite is a condition of the body, more common to women than men. Women have this condition in numerous parts of the body, as for example, on thighs, hips, stomach and upper arms, in the form of bulges and lumpy areas. It is thought that cellulite is a build up of fat, body fluids and toxic residues trapped in the tissues, however, it apparently is not an ordinary fat as it can not be lost by diet or exercise. The present invention is a method and apparatus for applying heat, pressure and a kneading action to aid in breaking down the fat cells or nodes so that the fluids present therein can be absorbed into the blood stream and eliminated by the normal waste elimination process.

The principal objects of the present invention are: to provide for massaging and kneading areas of the human body having cellulite therein by a rolling action of a plurality of closely spaced heated balls; to provide such an instrument wherein a plurality of closely spaced balls are supported under a base member for rotation with axes of rotation substantially parallel and generally in a plane spaced below the base member; to provide such a structure wherein the balls are movably mounted for movement in a direction normal to the axial plane thereof tending to equalize the pressure of the balls on an uneven surface engaged thereby; to provide such an instrument with heating means supported by the base member and positioned to apply heat to the balls and the body area thereunder; to provide such an instrument with means on the base member for accommodating a user's hand for manually manipulating the instrument to provide a mechanical massage action over areas of the body being treated; to provide a method of treating cellulite conditions of the body by rolling a series of balls under controlled pressure and heat over the areas of the body being treated; and to provide a method and apparatus for treating cellulite conditions of the human body which apparatus is economically manufactured, easily used and capable of long life in applying a rolling action under controlled pressure and heat that is effective in such treatment.

Other objects and advantages of the present invention will become apparent from the following detailed description taken in connection with the accompanying drawings wherein are set forth by way of illustration and example certain embodiments of the present invention.

The drawings constitute a part of this specification and include exemplary embodiments of the present invention and illustrate various objects and features of the apparatus.

Figures 1, 2, 3:
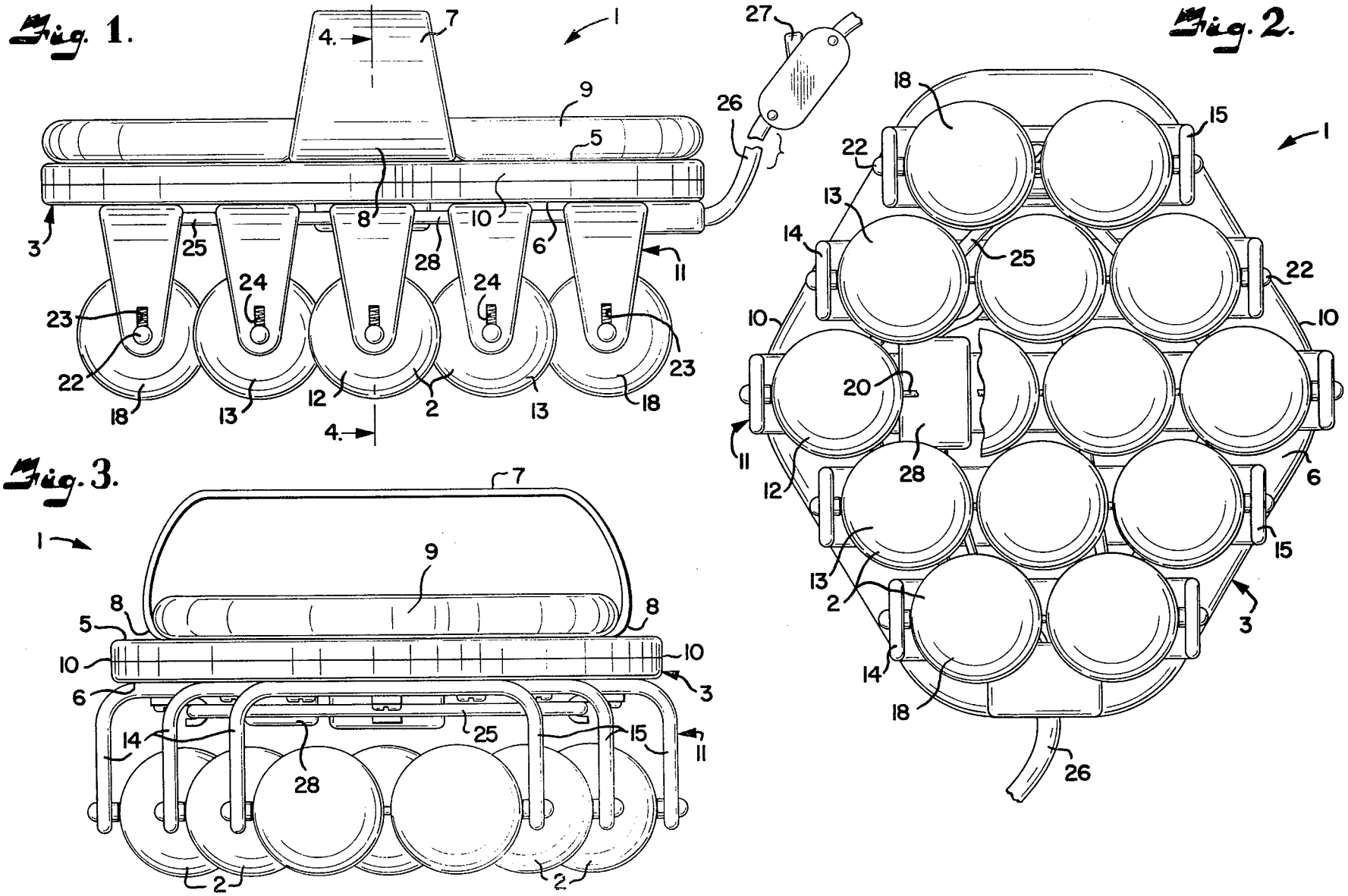
FIG. 1 is a side elevational view of the cellulite treating instrument.
FIG. 2 is a bottom view of the instrument showing the arrangement of balls thereon.
FIG. 3 is an end elevation of the instrument.

Referring more in detail to the drawings:

As required, detailed embodiments of the present invention are disclosed herein. However, it is to be understood that the disclosed embodiments are merely exemplary of the invention which may be embodied in various forms. Therefore, specific structural and functional details disclosed herein are not to be interpreted as limiting, but merely as a basis for the claims as a representative basis for teaching one skilled in the art to variously employ the present invention in virtually any appropriate manner.

The reference numeral 1 generally designates a cellulite treating instrument having a plurality of rolling balls 2 arranged with their axes of rotation substantially in a plane but movably mounted for movement in a direction generally normal to said plane to aid in providing a substantially uniform pressure of the balls on the body area being treated. The structure carrying the plurality of balls is movable relative to the body area to be treated so as to roll the balls thereover, said instrument being arranged to provide heat and pressure to the balls during such movement.

In the structure illustrated, a base plate or member 3 is generally planar and substantially larger than the hand of a user and has an upper surface 5 and a lower surface 6. The base member may be of a single material or a combination with the upper portion being of material having low heat conductivity and an electrical nonconductor so it may be safely in contact with the hand of the user. In a structure for manual manipulation, a suitable loop or handle 7 has ends 8 secured to the base member 3 adjacent sides thereof and extends upwardly and over same in a direction generally transversely thereof in the form of a loop or handle 7 that may be a flexible strap so that a user's hand is placed between the strap and the base member for manipulating same. It is preferred that the upper surface 5 of the base member be covered with fabric or cushion material as at 9 for aiding in the contact of the hand and fingers therewith in the movement of the instrument. The loop or handle 7 illustrated, is in the form of a fabric strap with ends 8 suitably secured adjacent the sides 10 of the base member 3, however, it may be in the form of a glove or mitt wherein the sides and one end would be secured to the base member leaving the other end open for insertion of the user or operator's hand.

The plurality of balls 2 are supported on the base member 3 in depending spaced relation to the bottom surface 6 thereof. The ball mounting structure 11 provides for the balls to be arranged with their axes substantially in a single plane, parallel to the lower surface 6 of the base member. Also it is preferred that the balls be uniform in size preferrably between $\frac{3}{4}$ and $1\frac{1}{2}$ inches and arranged in rows with the axes of one row parallel with the axes of adjacent rows. The balls in one row are off set realtive to balls in adjacent rows, for example, the balls of one row 12 are off set relative to the balls of an adjacent row 13 whereby the surfaces of the balls are only slightly spaced from the adjacent balls, the spacing preferably being at a minimum that would still provide for rolling of the balls without interference with the rolling of an adjacent ball. The ball axles of adjacent rows preferably have a spacing in the nature of nine tenths of the diameter of the balls for desired spacing of each of the balls from adjacent balls. Also the balls are preferably resiliently or movably mounted whereby they can move in a direction substantially normal to the plane of the axes with resilient means urging the balls to return, whereby the balls will apply substantially uniform pressure to the body surface when rolled over uneven areas.

In the structure illustrated, the base member has a plurality of depending pairs of arms forming support members 14 and 15 at each end of each row of balls. The arms or support members preferably are fixed at respective sides of the base member 3 and extend downwardly therefrom with the arms or support members for each row having suitable spacing to accommodate the number of balls in the respective row. The pairs of arms or support members are also spaced apart longitudinally of the base member 3 to provide the desired spacing of the rows. In the structure illustrated, the row 12 midway the length of the instrument has the greatest number of balls and the next adjacent rows 13 have one less ball in the particular illustration, the row 12 having four balls, the rows 13 each having three balls and the end rows 18 each having two balls, there being five rows of balls. Each ball has a through bore 19 to receive a supporting rod or axle 20. There is a rod or axle 20 for each row with the ends thereof suitably mounted and secured in the respective pair of arms or supporting members 14 and 15. The axles 20 form the rolling support of the balls. It is preferred that the rod or axle be resilient and it may be in the form of a small wire that will flex up and down or it may be in the form of a coil spring or other suitable axle structure that will permit movement of the balls in directions normal to the plane of the axes thereof, whereby the balls will move over uneven surfaces and apply substantially uniform pressure over the area in contact therewith.

The axles 20 are such that the balls rotate thereon, said axles being non-rotating. The ends of the axles extend through bores 21 in the support members 14 and 15 and have heads 22 on ends thereof to limit endwise movement of the axles. The axles may be mounted in slots or guides 23 in the support members 14 and 15 for limited vertical movement with resilient members 24 to urge same to the lowermost position to aid in the permitting of the resilient movement of the balls. The structure is such that the balls have independent limited vertical movement either by flexing of the axle or the vertical movement in the supports 14 and 15 or both, the limited movement being such that the balls are not permitted to rise sufficiently to contact the heating elements arranged as later described.

Controlled heat is applied to the balls 2 and in the structure illustrated, electrical heating elements 25 are suitably supported under the lower surface 6 of the base member near the upper portions of the balls with the elements being arranged to substantially uniformly heat the area under the base member to thereby uniformly heat the balls. The heating elements are connected to an electrical cord 26 adapted to be connected to a suitable source of electric current. A manual switch 27 is arranged in the electrical circuit for controlling same and also there is a thermostat switch 28 in the electrical circuit between the manual switch 27 and the heating elements 25, said thermostat being sensitive to the heat of the balls to interrupt the circuit when the temperature of the balls reaches a predetermined maximum.

In treating cellulite contained areas of the human body, the instrument 1 may be used by the person having the condition or by another person as operator. The person having the condition is placed in a suitable position wherein the areas containing the cellulite are exposed. Then the electrical cord 26 is connected to a suitable electrical supply such as a house current outlet and the manual switch 27 is actuated to complete the circuit to the electrical heating elements 25. The user's hand is then inserted into the opening between the base member 3 and the loop or mitt 7 with the palm facing the cushion material 9 and the instrument moved to position same on the areas to be treated. After completing the circuit by actuation of the switch 27, the heating elements are energized and the temperature will increase until at a predetermined temperature and the switch 28 interrupts the circuit, the heat from the heating elements 25 being transmitted to the balls. The instrument is then moved back and forth with the user applying some pressure whereby the balls 2 roll over the uneven surfaces and move up and down in response thereto to apply substantially uniform pressure over the area. This pressure with the heat and massaging from the rolling action provides a kneading to increase the circulation in the area and aids in breaking down the fat nodes. This treatment should be continued for a suitable period of time and repeated each day to gradually reduce the cellulite condition.

Figure 5:
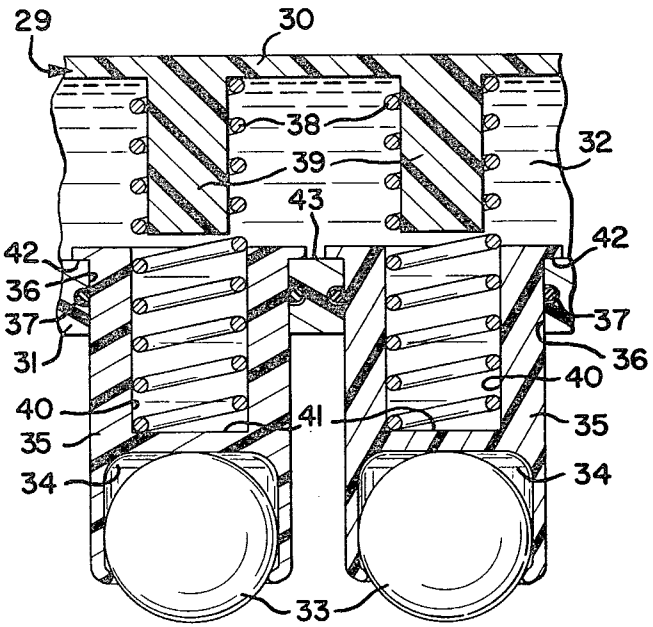
FIG. 5 is an enlarged fragmentary sectional view through a modified form of ball mounting in which pressure and heat are supplied by heated fluid.
Figure 4:
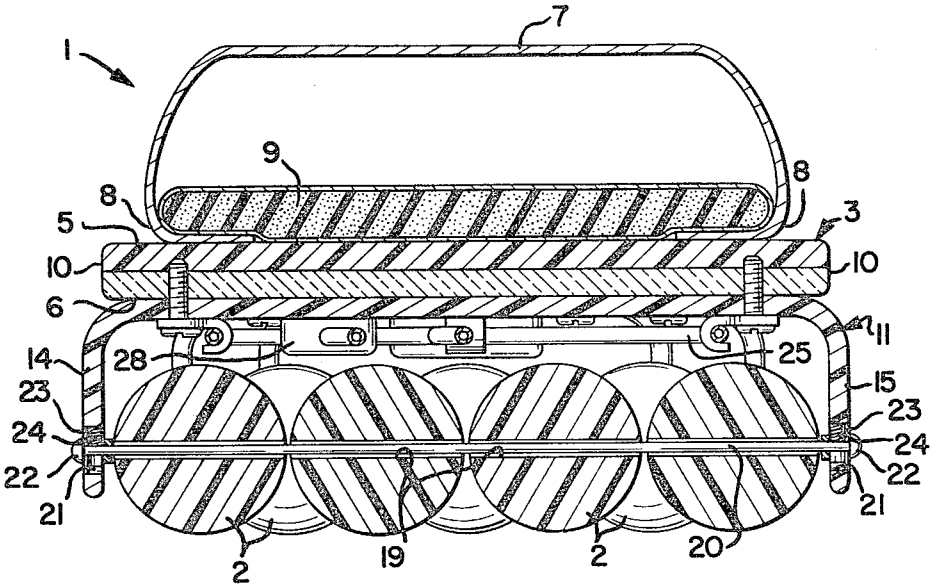
FIG. 4 is a transverse sectional view through the instrument taken on the line 4—4 FIG. 1 and showing the balls in a partially raised position.

In the form of the invention illustrated in FIG. 5, a base plate or member 29 is hollow with top and bottom walls 30 and 31 respectively having a fluid receiving chamber 32 therebetween. The balls 33 are rotatably received in sockets 34 of pistons 35 slidably mounted in bores 36 extending through the bottom wall 31. Suitable seal means 37 is arranged in the bores 36 to form a seal between the surface of the piston and the surface defining the respective bore 36. Springs 38 are sleeved on guides 39 extending from the top wall 30, said springs extending into recesses 40 and engaging a wall 41 to urge the pistons 35 downwardly to engage stop members 42 on the pistons with the upper surface 43 of the bottom wall 31 to limit the downward travel of the pistons. Fluid with a controlled temperature is supplied to the space or chamber 32 to provide a pressure acting on the pistons 35 and also to heat the pistons and also provide heat for the balls 33. The structure having such an arrangement of the balls is moved over the cellulite containing areas of the body with a pressure that causes the pistons to move upwardly in the bores 35. The heated fluid provides heat to the balls and also pressure to the pistons, the pressure resulting in the balls applying a substantially uniform pressure to the uneven areas of the body over which the instrument is moved. With this structure the general arrangement of the balls is the same as shown in FIG. 2 with the balls having the additional spacing necessary to provide for the wall portions between the bores 36. The use of such instrument is substantially the same as described in the above.

It is to be understood that while I have illustrated and described certain forms of my invention, it is not to be limited to the specific form or arrangement of parts herein described and shown.

What I claim and desire to secure by Letters Patent is:

1. An instrument for treating areas of the human body having cellulite therein comprising:

(a) a base member having an upper portion and a lower portion;

(b) a member connected to said base member and adapted for connecting a user's hand to said base member for manipulating and applying pressure thereto;

(c) a plurality of balls;

(d) means on said base member rotatably supporting said balls below and spaced from the base lower portion with the balls closely spaced and the centers thereof generally in a plane substantially parallel to said base member, the mounting permitting substantially independent movement of the balls in a direction normal to said plane;

(e) controlled heating means mounted on said base lower portion and positioned between said balls and said base member; said heating means being spaced a predetermined distance from said balls and transmitting heat thereto through air convection; and (f) means applying pressure to the balls to urge same downwardly to said plane and tending to equalize pressure of the balls on an uneven surface engaged thereby.

2. An instrument as set forth in claim 1 wherein:

(a) said support means include pairs of arms on said base member and depending therefrom, and an axle member mounted on each pair of said arms, at least two of said balls being rotatably mounted on each of said axle members; and (b) said balls being arranged in rows with the balls on one axle being in one row and off set relative to balls on an axle in an adjacent row to provide close spacing between each ball and two adjacent balls on the adjacent axle.

3. An instrument as set forth in claim 2 including:

(a) means limiting the movement of the balls in the direction normal to said plane and preventing engagement between said balls and said heating means.

4. An instrument as set forth in claim 3 wherein:

(a) said axle members are mounted in slots disposed in an associated pair of arms; and including (b) a coil spring disposed in each of said slots and resiliently urging said axle members away from said base member.

5. An instrument as set forth in claim 1 wherein:

(a) said heating means are electrical heating elements supported by the base member between the lower portion thereof and said balls and a connection to a source of electric current with a thermostatic switch operative to interrupt the current when the temperature adjacent the balls is at a predetermined maximum; and (b) said means urging the balls downwardly is a resiliency of the mounting of the balls.

6. An instrument as set forth in claim 1 wherein:

(a) said base member being generally planar and of an area larger than a person's hand with an upper portion of a cushion material for engagement by the palm and fingers of a user's hand;

(b) said base member has portions that are of material that are electrically non-conductors and of low heat conductivity to protect the hand of the user from the heat and current; and (c) said member comprising a strap extending over a portion of the base upper portion and co-operating therewith to define an opening for receiving the hand of the user therein.

7. An instrument as set forth in claim 1 wherein:

(a) said ball supporting means are pistons slidably mounted in bores in the base member with sockets in lower ends of the pistons having the respective ball rotatably contained therein, said pistons and base member have cooperative abuttments limiting movement of the pistons outwardly of the base member;

(b) said base member being hollow and having a chamber therein connected to a source of fluid of controlled temperature and under a selected pressure whereby said fluid heats the pistons and balls and urges the pistons outwardly of the body member; and (c) seal means in said bores and engaging said pistons.

* * * * *